US006056597A

United States Patent [19]

Shepherd et al.

[11] Patent Number: 6,056,597

[45] Date of Patent: May 2, 2000

[54] ELECTRICAL ASSEMBLY WITH SPRING CLIPS CONNECTING TO CABLE SCREENS

[75] Inventors: Brian Shepherd, Wendover; Peter Dent, London, both of United Kingdom

[73] Assignee: Smiths Industries Public Limited Company, London, United Kingdom

[21] Appl. No.: 09/086,534

[22] Filed: May 29, 1998

[30] Foreign Application Priority Data

Jun. 17, 1997 [GB] United Kingdom ..... 9712458

[51] Int. Cl.[7] ..... H01R 9/05

[52] U.S. Cl. ..... 439/579; 439/610

[58] Field of Search ..... 439/579, 610, 439/497, 95, 98, 99, 465, 469, 906

[56] References Cited

U.S. PATENT DOCUMENTS

| | | | |
|---|---|---|---|
| 5,281,762 | 1/1994 | Long et al. | 439/497 |
| 5,402,315 | 3/1995 | Reichle | 439/95 |
| 5,618,202 | 4/1997 | Okuyama et al. | 439/579 |
| 5,713,748 | 2/1998 | Mulvihill | 439/579 |
| 5,785,555 | 7/1998 | O'Sullivan et al. | 439/610 |

FOREIGN PATENT DOCUMENTS

| | | |
|---|---|---|
| 0 694 989 | 1/1996 | European Pat. Off. . |
| 0793297A2 | 9/1997 | European Pat. Off. . |
| 1353890 | 5/1974 | United Kingdom . |
| 2294367 | 4/1996 | United Kingdom . |

*Primary Examiner*—Paula Bradley
*Assistant Examiner*—Tho D. Ta
*Attorney, Agent, or Firm*—Pollock, Vande Sande & Amernick

[57] ABSTRACT

An electrical connector has a row of metal spring clips mounted on the lower half of its outer shell to the rear of the contact block. Screened cables enter the rear of the connector, each screening sheath being doubled over and trapped between an inner stiffening tube and an outer metal collar. The clips make electrical contact with the screening sheaths via the collars. A clamping member on the upper half of the shell bears on the cables on opposite sides of the clips.

9 Claims, 1 Drawing Sheet

ELECTRICAL ASSEMBLY WITH SPRING CLIPS CONNECTING TO CABLE SCREENS

BACKGROUND OF THE INVENTION

This invention relates to electrical connection.

The invention is more particularly concerned with electrical connection to the screening sheath of an electrical cable, such as where the cable is connected to an electrical connector.

In electrical connectors having many contacts, it can be very difficult to provide effective termination of the screening sheaths on the individual cables to the connector ground body, because of the limited space. Another problem is in providing a connector that can be serviced easily, enabling ready access to the individual cables so that these can be repaired or modified.

SUMMARY OF THE INVENTION

It is an object of the present invention to provide an improved electrical connection of a screening sheath.

According to the present invention there is provided an electrical assembly having a plurality of electrical contacts insulated from a conductive ground member and a plurality of cables each having at least one wire connected with respective ones of the contacts and an outer screening sheath electrically connected with the ground member, the assembly including an array of spring clip members electrically connected with the ground member, and the spring clip members being adapted to make electrical contact with the screening sheaths on respective ones of the cables.

Each cable may have an inner stiffening tube inserted under the outer screening sleeve, the stiffening tube extending along a region of the cable contacted by the clip members. Each cable may include an outer collar of an electrically-conductive material extending along the screening sheath in the region of the clip members. The screening sheath is preferably doubled over within the outer collar. The assembly preferably includes a clamping member arranged to clamp the cables with respect to the clip members. The clamping member preferably has V-shape grooves on opposite sides of the clip members to receive respective ones of the cables. The clamping member is preferably fixed with one half of an outer shell of the assembly. The clip members may be pressed from a common strip of metal and each may have a pair of oppositely bowed spring fingers. The assembly may be a connector, the electrical contacts being arranged to make contact with cooperating contacts in a mating connector.

An electrical connector according to the present invention, will now be described, by way of example, with reference to the accompanying drawing.

DETAILED DESCRIPTION OF THE PREFERRED EMBODIMENT

Figure 1:
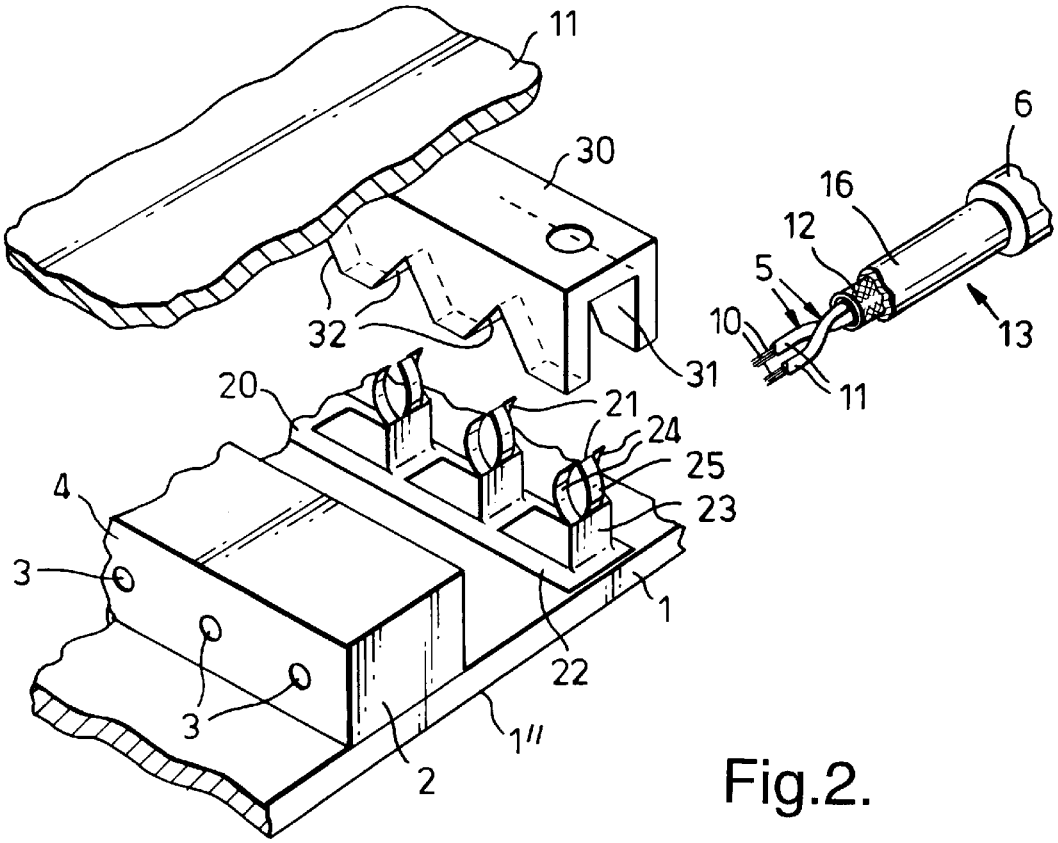
FIG. 1 is a perspective, cut-away view of a part of the connector.
Figure 2:
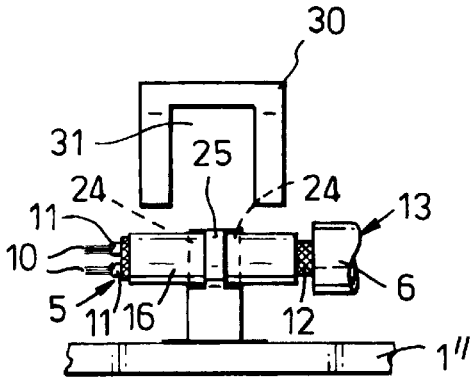
FIG. 2 is a side elevation view of a part of the connector.

The connector has a generally rectangular metal outer shell 1, formed in an upper half 1' and a lower half 1", and a contact mounting block 2 having an array of contact elements 3 of a conventional kind. In use, the shell 1 of the connector is grounded, in the usual way. The contact elements 3 are exposed on the front surface 4 of the block 2 for mating connection with a cooperating connector (not shown). At the rear surface of the block 2, the contact elements 3 are connected to respective ones of individual wires 5 in several twisted-pair cables 6, only one of which is shown.

Figure 3:
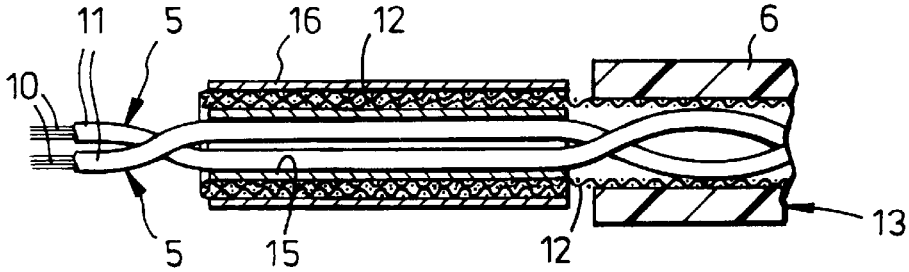
FIG. 3 is a sectional side elevation view of a cable to an increased scale.

The wires 5 each have a stranded metal filament core 10 encase within an outer electrically-insulative sleeve 11, the sleeve being stripped back a short distance from the end of the wires to expose the core so that this can be connected to one of the contact elements 3. Each cable 6 has two such wires 5 twisted together and extending within a braided wire screening sheath or sleeve 12, which is protected on its outer surface by an electrically-insulative jacket 13. The braided screening sleeve 12 is stripped back from the cable over a distance of about 20 mm, to expose the two wires 5. The outer jacket 13 is stripped back by about a further 20 mm, to expose the screening sleeve 12. As shown in FIG. 3, the screening sleeve 12 is folded back to give a double thickness where it is exposed beyond the jacket 13 and a rigid, stiffening tube 15 about 10 mm long is inserted within the sleeve. The stiffening tube 15 is a close, push fit under the screening 12 and encompasses the two wires 5. The tube 15 is preferably made of a metal, such as brass, but could be of an insulative material since it is not itself required to make any electrical interconnection. Each cable 6 also has an outer collar 16 encompassing the screening sleeve 12 where it is exposed, so that the sleeve is trapped between the inner tube 15 and the outer collar. The outer collar 16 is of a deformable metal that is crimped about the screening 12 and the underlying tube 15, so that it makes a low impedance electrical contact with the screening sleeve 12. The collar 16 may be gold plated to ensure reliable electrical contact.

A grounding assembly 20 in the connector has an array of spring clip members 21, one for each cable 6, projecting upwardly from a common horizontal strip or plate 22. The strip 22 is mounted on the floor of the lower half 1" of the connector shell and is in low impedance electrical contact with the shell. The clip members 21 are formed by pressing from the strip 22, which is of a resilient metal such as beryllium copper. Each clip 21 comprises a vertical, square base 23 from which project a pair of upwardly-extending fingers 24 bowed in one direction and a single finger 25 bowed in the opposite direction and located between the fingers of the pair. The location of the clip members 21 and the shape of the fingers 24 and 25 are such that the fingers will grip opposite sides of the outer collar 16 of respective cables 6, when the cables are located to lie between adjacent clip members.

The connector also has a clamping member 30 mounted on the upper half 1' of the connector shell 1, projecting down from its roof and extending laterally across the connector above the grounding assembly 20. Alternatively, the clamping member 30 could be fastened to the lower half 1" by screws at each end. The clamping member 30 is a metal bar of square section with an axial slot 31, or a series of cavities, along its lower surface. The clamping member 30 also has series of lateral V-shape grooves 32 extending parallel to one another and to the axis of the connector. The clamping member 30 is wider than the grounding assembly 20 and the dimensions of the slot or cavities 31 are such that the clip members 21 are received in the slot or cavities when the clamping member is fastened onto the lower half 1". The location of the clamping member 30 is such that when the two halves of the connector shell 1' and 1" are assembled together, the clamping member is fastened down onto the lower half of the shell with the sides of the grooves 32 engaging and compressing the collar 16 of each cable assembly on opposite sides of the clip members 21. This clamping is sufficient to form a gas-tight electrical connection that will prevent the ingress of moisture between the contacting electrically-conductive surfaces. The grounding assembly 20 grips the cables 6 sufficiently firmly for them to be retained in position without the clamping member 30 being in place, so that the cables are not disturbed when the clamping member 30 is removed.

The present invention provides an effective 360° electrical connection between the shell of the connector and the cable screening, without the need to form the screening sleeve into an extended jumper lead, which could result in an increased inductance. The present invention also enables individual cables to be accessed without the need to disturb other cables, thus greatly improving serviceability.

What we claim is:

1. An electrical assembly comprising: a plurality of electrical contacts; a conductive ground member insulated from said contacts; a plurality of cables, each said cable having an outer screening sheath and at least one wire extending along said sheath and connected with respective ones of said contacts; an inner stiffening tube inserted under said outer screening sheath along a region of said cable; an array of spring clip members, said clip members being electrically connected with said ground member and adapted to make electrical contact with each said screening sheath so as to embrace a respective one of said cables in said region to electrically connect said screening sheaths to said ground member, and a clamping member mounted to a parts of said assembly, said clamping member being arranged to clamp said cables with respect to said clip members.

2. An electrical assembly according to claim 1, wherein said clamping member has V-shape grooves on opposite sides of said spring clip members to receive respective ones of said cables.

3. An electrical assembly according to claim 1, wherein said assembly has an outer shell in two parts, and wherein said clamping member is fixed with one of said parts of said outer shell.

4. An electrical assembly according to claim 1, wherein each said spring clip member has a pair of oppositely bowed spring fingers.

5. An electrical connector according to claim 1, wherein said electrical contacts are arranged to make contact with cooperating contacts in a mating connector.

6. An electrical assembly according to claim 1, wherein each said cable includes an outer collar of an electrically-conductive material, and wherein said collar extends alone said screening sheath in the region of said clip members.

7. An electrical assembly according to claim 6, wherein said screening sheath is doubled over within said outer collar.

8. An electrical connector comprising: a plurality of electrical contacts; a conductive outer shell insulated from said contacts, said shell having two parts; a plurality of cables, each said cable having at least one insulated wire connected with respective ones of said contacts, an outer screening sheath extending along said wires and an inner stiffening tube inserted under the screening sheath along a region of the cable; an array of spring clip members, said clip members being mounted on one of the parts of said outer shell in electric contact with said shell, said clip members each having spring fingers, and each said cable extending between said spring fingers so that said spring fingers electrically connect each said screening sheath to said outer shell and an electrically-conductive clamping member mounted on the other part of the outer shell, and wherein said clamping member is shaped to hear on each said cable on opposite sides of said clip members.

9. An electrical assembly comprising: a plurality of electrical contacts; a conductive ground member insulated from said contacts; a plurality of cables, each said cable having an outer screening sheath and at least one wire extending along said sheath and connected with respective ones of said contacts; an inner stiffening tube inserted under said outer screening sheath along a region of said cable and an array of spring clip members pressed from a common strip of metal, said clip members being electrically connected with said ground member and adapted to make electrical contact with each said screening sheath so as to embrace a respective one of said cables in said region to electrically connect said screening sheaths to said ground member.

* * * * *